US005263513A

United States Patent [19]

Roe

[11] Patent Number: 5,263,513

[45] Date of Patent: Nov. 23, 1993

[54] DUAL FLOW PASSAGE POPPET VALVE

[76] Inventor: Steven N. Roe, 21 Hillbarn Ct., San Mateo, Calif. 94403

[21] Appl. No.: 948,671

[22] Filed: Sep. 22, 1992

[51] Int. Cl.[5] ..... F15B 13/042; F15B 13/044

[52] U.S. Cl. ..... 137/627.5; 137/596.15; 137/596.17; 137/625.27; 137/870

[58] Field of Search ..... 137/596.17, 625.27, 137/627.5, 870, 596.15

[56] References Cited

U.S. PATENT DOCUMENTS

| | | | |
|---|---|---|---|
| 3,081,790 | 3/1963 | Radford | 137/627.5 X |
| 3,294,120 | 12/1966 | Ruchser | 137/627.5 |
| 3,815,634 | 6/1974 | Dowdall et al. | 137/627.5 |
| 3,893,484 | 7/1975 | Greene | 137/596.17 X |

*Primary Examiner*—Gerald A. Michalsky

*Attorney, Agent, or Firm*—Kam T. Tam

[57] ABSTRACT

A dual passage valve with four way controls comprises a synchronized poppet combination reciprocally mounted within the valve housing. There is a bore axially formed in the housing with two fluid passageways located at the proximal and distal ends of the bore. There are also inlet and outlet ports formed in the housing with the inlet port extending radially from the bore, and the outlet port having conduits extending into the two fluid passageways. The synchronized poppet combination selectively encloses and opens the bore to the two passageways allowing fluid to traverse through, stops at, and reverse from the valve synchronously in a one-stroke linear motion within the bore. The synchronized poppet combination distinctively dictates the fluid flow traffic and strictly forbids any disorderly fluid flow states within the valve.

13 Claims, 6 Drawing Sheets

DUAL FLOW PASSAGE POPPET VALVE

BACKGROUND OF THE INVENTION

1. Field of the Invention

The present invention relates to a fluid valve. In particular, this invention is related to a four-way control valve with dual flow passageway for regulating hydraulic or pneumatic fluid.

2. Description of the Related Art

Four way control valves are commonly used to control a variety of mechanical devices such as linear cylinders, rotary motors or robotics actuators. In applications where precise fluid flow control are demanded, or high switching frequency are required, spool-type valve with accurate manufacturing tolerance are commonly employed. These type of valves are very expensive to build due to the tight tolerance requirements plus the need to use durable materials. Valves of these type are exemplified by the teachings of U.S. Pat. Nos. 4,611,632 to Kolchinsky, Sep. 16, 1986; 4,310,143 to Determan, Jan. 12, 1982, and 4,457,341 to Aspinwall, Jul. 3, 1984. In these type of valves, pistons are generally fixedly attached to a shaft. The shaft with the pistons are mounted within a housing. Fluid ports with predetermined locations are formed through the housing. The reciprocal movement of the shaft inside the housing allows the pistons to close and open selected fluid ports and perform the dual flow passage function. To ensure that the valve is leakproof, geometrical tolerances between pistons and housing bore are critical. Moreover, to achieve the goal of the high speed operation, piston widths relative to the fluid port opening sizes need to be precisely matched. These stringent requirements substantially increase the manufacturing cost and prevent the spool-type valves from being commonly used.

To alleviate the aforementioned shortfalls, poppet-type valves were invented in the past. A typical valve of this category is disclosed in U.S. Pat. No. 4,821,774 to Chorkey, Apr. 18, 1989. The valve normally comprises two poppets fixedly attached to a shaft. Coil springs are fastened at both ends of the shaft and the entire assembly is mounted within a housing. Fluid ports with predetermined locations are formed through the housing. The reciprocal movements of the shaft inside the housing enable the poppets to close or open selected fluid ports and perform the duty of dual flow passage. However, the monotonous movement of the shaft with fixed poppets can only avail the valve to assert the fluid traverse and reverse positions. In between the change of positions, an ambiguous transitory period appears where all fluid ports are connected together. Fluid flow directions are at a undetermined state. This period of uncertainty seriously deteriorates the valve performance in terms of operating speed and the switching frequency.

The advent of present day electronics make it possible for valve control circuitries running at a very fast speed. However, the overall operational speed of any electrol-mechanical systems is still restricted by the relatively slower mechanical parts in which control valves are key components. To optimize any electrol-mechanical design, the availability of a high-speed valve is of major importance.

SUMMARY OF THE INVENTION

Heretofore, four way type control values are built with expensive materials and with high manufacturing tolerances. As a consequence, four way control valves are unavailable for common applications. Existent poppet-type four way control valves are less expensive but their performances deteriorate at high-frequency operations. The valve of the present invention is designed to circumvent these drawbacks.

The valve of the present invention is characterized by a fluid traverse position, a fluid closed position, and a fluid reverse position. A synchronized poppet means is utilized to assert the three fluid positions, and the assertion of the three positions can be accomplished in a one-stroke linear movement of the synchronized poppet means within the valve housing. In this specification and in the appended claims, the term "synchronized" is a grammatical adjective and is specifically construed to describe an object capable of completion of one event in one state before the start of the another event in another state, with no overlaps of events in the time domain. The term "sychronously" is the grammatical adverb thereof. Thus the term "synchronized" when applied to a component or a group of components of a valve specifically means that the component or the group of components is capable of completion as being in one configuration in one fluid position before the start of being in another configuration in another fluid position. There is never any simultaneous overlaps of fluid positions in existence.

In a preferred embodiment of the present invention, the valve comprises a synchronized poppet means encased within a valve housing. The valve housing has a bore. The bore achieves fluid communications with the outside world through fluid ports formed in the valve housing. Electromagnets are adopted to actuate the reciprocal movements of the synchronized poppet means within the valve housing. By opening and closing selected fluid ports, the synchronized poppet means is able to traverse the fluid flow, completely shuts off all fluid flow, and reverse the fluid flow, all within a one-stroke linear movement of the synchronized poppet means within the housing bore. Since there is no ambiguous transitory fluid flow state as in the prior art poppet-type valves, response time is substantially reduced. Subsequently, high frequency operation is possible. Moreover, due to the less stringent tolerance requirements and with the wider choices of less expensive materials. The valve of the present invention is especially suitable for miniaturization applicable in complex electromechanical systems. Equally important, the valve of the present invention can operate proportionally. Specifically, actuating means such as the electromagnets can proportionally reciprocates the synchronized poppet means within the bore whereby fluid flows within the valve can be proportionally regulated. Another feature of the valve of the present invention is that due to its unique design, steady state fluid flow can be manually and externally adjusted without resorting to any dissembling.

It is the object of the present invention to provide a high performance valve with less stringent tolerance requirements, can be built with inexpensive light-weight materials and thus capable of high switching frequency operations.

It is another object of the present invention to provide a valve that are especially suitable for miniaturization.

It is a yet another object of the present invention to provide a valve that can proportionally regulate the fluid flow.

It is a further object of the present invention to provide a valve that is easily serviceable.

It is yet a further object of the present invention to provide a that the can be manufactured at a low cost.

DETAILED DESCRIPTION OF THE PREFERRED EMBODIMENT

Figure 1A:
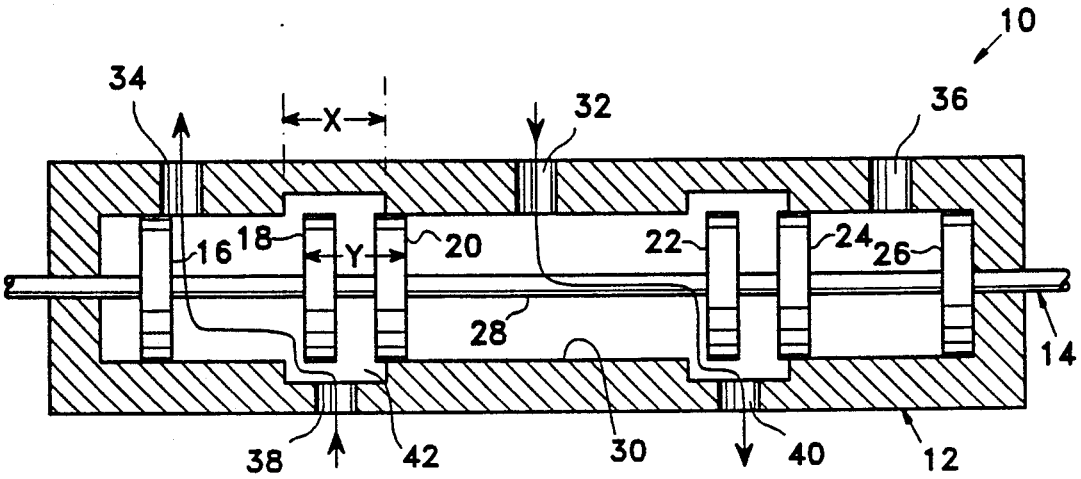
Fig. 1A (PRIOR ART)
FIG. 1A shows a cross-sectional side view of a conventional spool-type valve at its fluid traverse position.
Figure 1B:
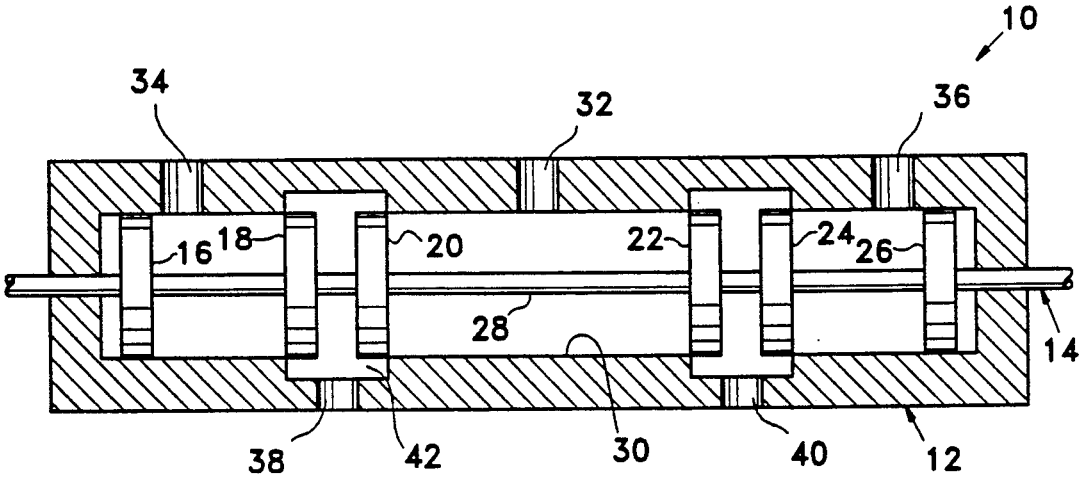
Fig. 1B (PRIOR ART)
FIG. 1B shows a cross-sectional side view of the same of spool-type valve as shown in FIG. 1A at its fluid closed position.
Figure 1C:
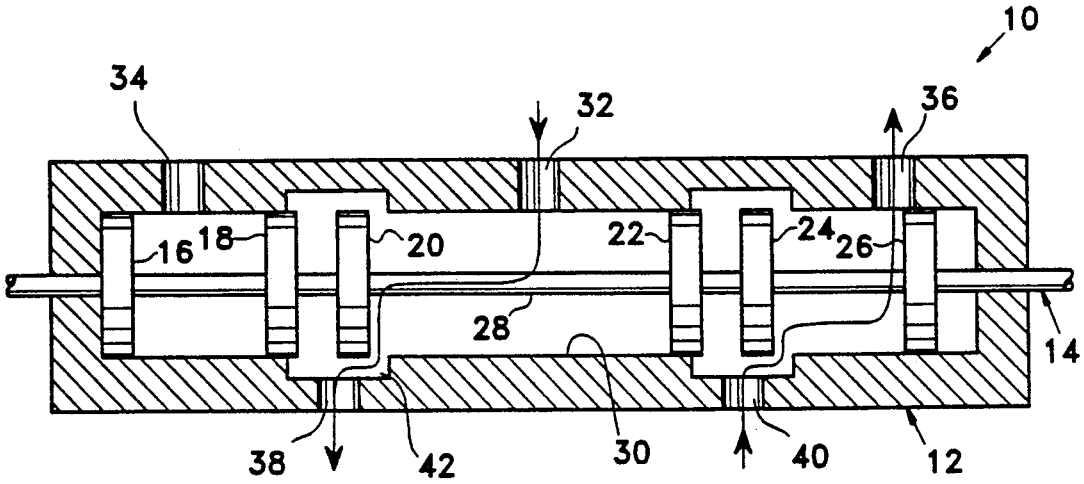
Fig. 1C (PRIOR ART)
FIG. 1C shows a cross-sectional side view of the same spool-type valve as shown in FIGS. 1A and 1B at its fluid reverse position.

Referring now to FIGS. 1A to 1C. The conventional spool-type valve is signified by reference numeral 10. Valve 10 comprises a housing 12 and a spool assembly 14. Spool Assembly 14 is built with pistons 16–26 fixedly attached to shaft 28. Spool assembly is mounted within housing 12 and is capable of reciprocal movement within bore 30 of housing 12. Inlet port 32, first return port 34, second return port 36, first control port 38, and second control port 40 are all formed within housing 12 and generally extending radially through bore 30 as shown in FIGS. 1A to 1C. Notice that first control port 38 and second control port 40 are in direct fluid communication at a fluid path external to valve 10. The fluid path is normally located in the mechanical device being actuated. The communication linkage is not shown in the drawings.

FIG. 1A depicts valve 10 at a fluid traverse position whereby fluid is being forced into inlet port 32 from a fluid pressure source (not shown) and out of control port 40. fluid from control port 40 flow through fluid linkage in the actuated device (not shown) and returns back to first control port 38 and passes out of valve 10 through first return port 34. To reverse the direction of fluid flow, shaft 28 is pushed to the left and attains a temporary fluid closed position as shown in FIG. 1B, whereby fluid flow in both control ports 38 and 40, inlet port 32 and return ports 34 and 36 are completely cut-off. Further movement of shaft 28 to the left direction enables valve 10 to be at its fluid reverse position as described in FIG. 1C. In this position, the fluid flow direction in each of the fluid port is completely reversed as compared to the corresponding ports in FIG. A. The opposite but simultaneous flow of fluid in and out of control ports 38 & 40 is utilized to actuate the movement of various mechanical devices.

Notice that in order to achieve the high-frequency operation objective, distance between piston-to-piston edge as signified by the letter Y in FIG. 1A needs to be as closely matched to the dimension of control port opening 42 signified by the letter X as possible. Undersize of distance Y causes fluid leakage while oversize of distance Y decreases the sensitivity of response for valve 10. Precise manufacturing tolerance is thus required in the production of valve 10. This criterion substantially increases the cost of manufacturing. Moreover, due to the close geometrical tolerance between surfaces of cylinders 16–26 and bore 30, and commonly exacerbated by other factors such as fluid contamination, prolong usage of valve 10 normally causes wear and tear between pistons 16–26 and bore 30 and may render valve 10 malfunctional.

Figure 2A:
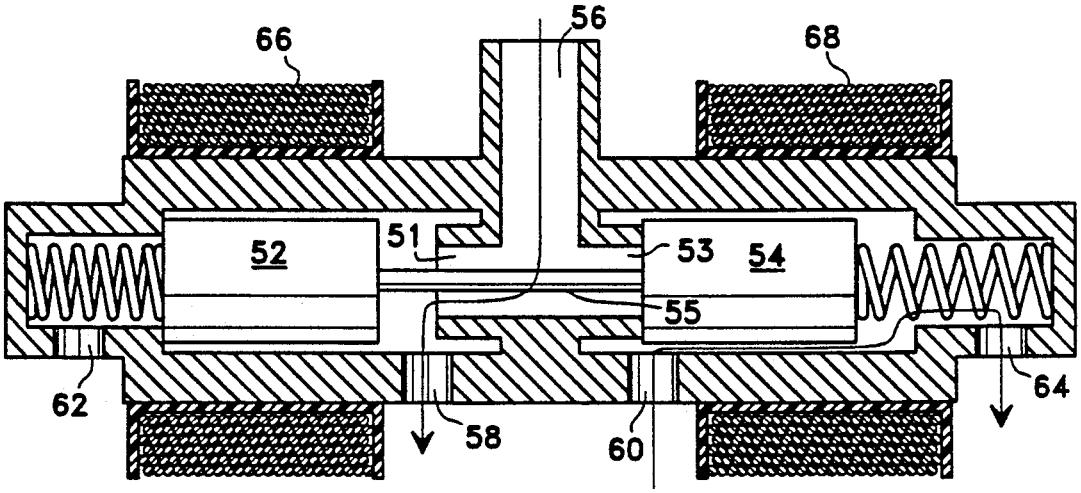
Fig. 2A (PRIOR ART)
FIG. 2A shows a cross-sectional side view of a conventional poppet-type valve at its fluid traverse position.
Figure 2B:
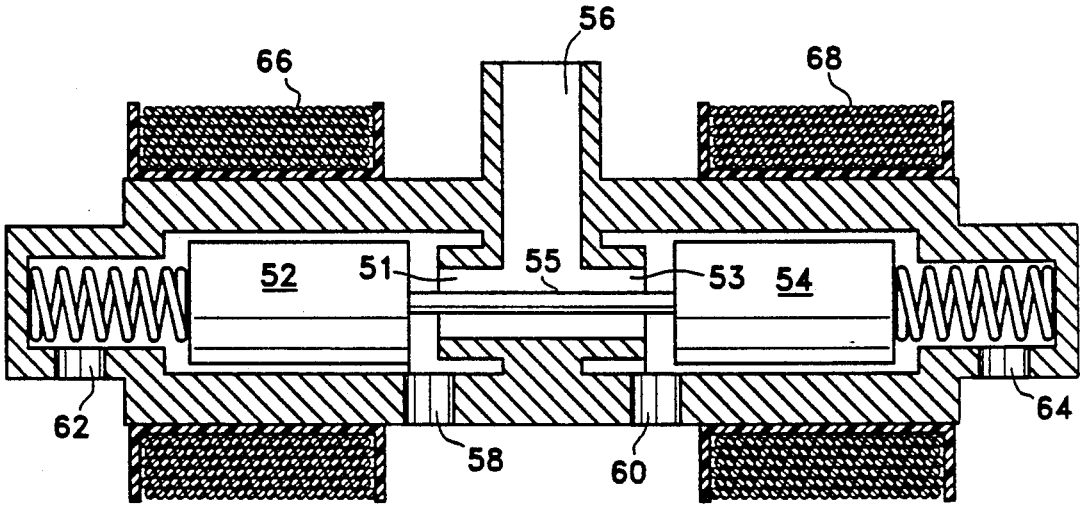
Fig. 2B (PRIOR ART)
FIG. 2B shows a cross-sectional side view of the same poppet-type valve as shown in FIG. 2A at its transitory position.
Figure 2C:
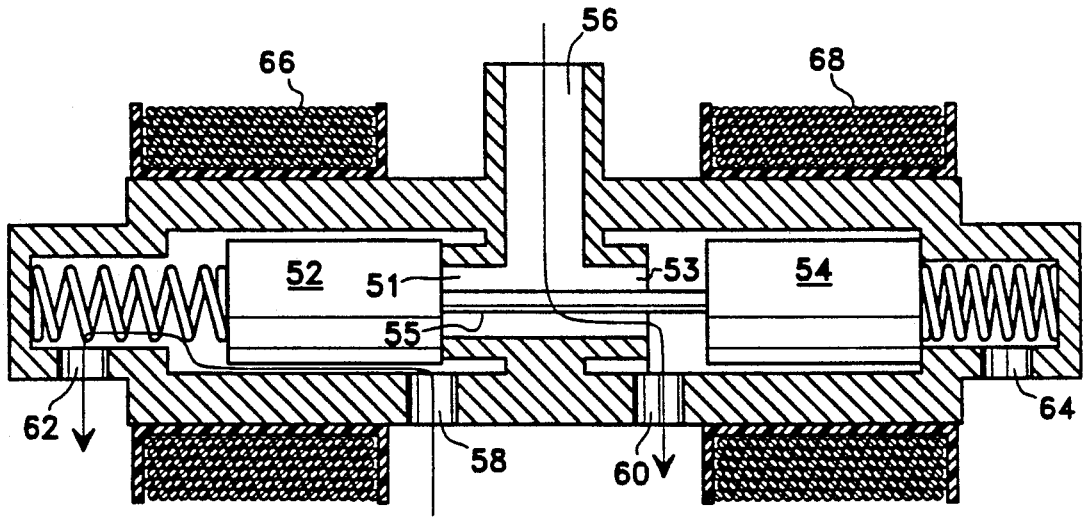
Fig. 2C (PRIOR ART)
FIG. 2C shows a cross-sectional side view of the same poppet-type valve as shown in FIGS. 2A and 2B at its fluid reverse position.

To bypass the above described disadvantages inherent with the spool-type valves, poppet valves are invented in the past as a replacement. The type most commonly used is shown in FIGS. 2A to 2C. In FIGS. 2A to 2C, the valve is signified by reference numeral 50. Poppets 52 and 54 are fixedly attached together through shaft 55. FIG. 2A shows valve 50 at its fluid traverse position with second poppet 54 closing opening 53. Fluid from pressure port 56 flows through opening 51 and out of first control port 58. Control port 58 and control port 60 are in direct fluid communication with each other at a fluid path external to valve 50. The fluid path is normally located in the mechanical device being actuated. The communication linkage is not shown in the drawings. Fluid from first control port 58 flows through communication linkage (not shown) and back into second control port 60. Fluid exits through valve 50 via second exhaust port 64.

To reverse the direction of fluid flow, shaft, 55 is pushed to the right. Valve 50 achieves a transitory position with all valve ports open and fluid flow directions undetermined as shown in FIG. 2B.

FIG. 2C shows valve 50 at its fluid reverse position with fluid flowing from inlet port 56 and out of second control port 60. Fluid from second control port 60 flows through a fluid linkage (not shown) in the mechanical device being, actuated and back into first control port 58. Fluid exits out of valve 50 through first exhaust port 62. The opposite but simultaneous flows of fluid in and out of control ports 58 and 60 is utilized to actuate the movement of various mechanical devices.

Returning now to FIG. 2B, with valve at its transitory position, valve 50 enters into a state of disorderly fluid flow. The monotonous reciprocating movement of shaft 55 with fixed poppets 52 and 54 can not be exercised with agility. Actuating means such as electromagnets 66 and 68 have to exert excessive force to overcome the ambiguous fluid flows within valve 50 which in turn, requires electromagnets 66 and 68 to be driven into deep magnetic saturation. With electromagnets 66 and 68 in saturation, recovery time for electromagnets 66 and 68 substantially increases which seriously undermines the valve performance.

The valve of the present invention is designed to bypasses all the aforementioned shortfalls.

Figure 3:
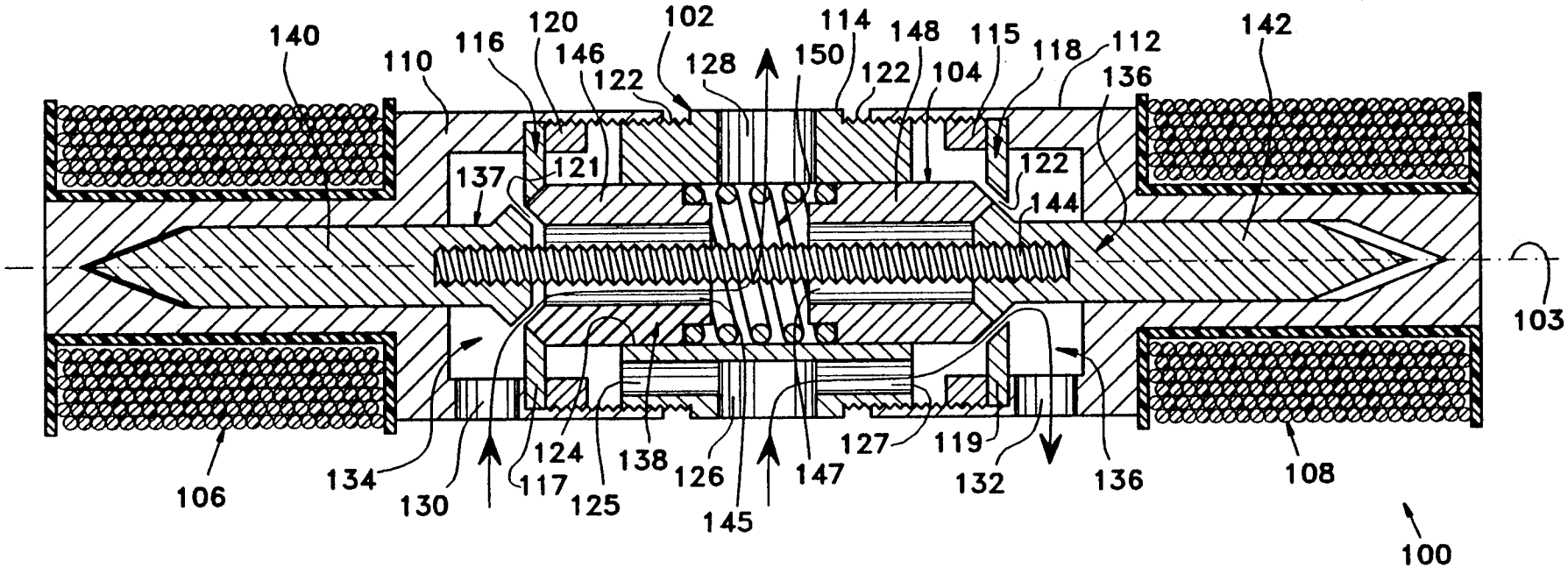
FIG. 3 shows a cross-sectional side view of the preferred embodiment of the present invention.
Figure 4:
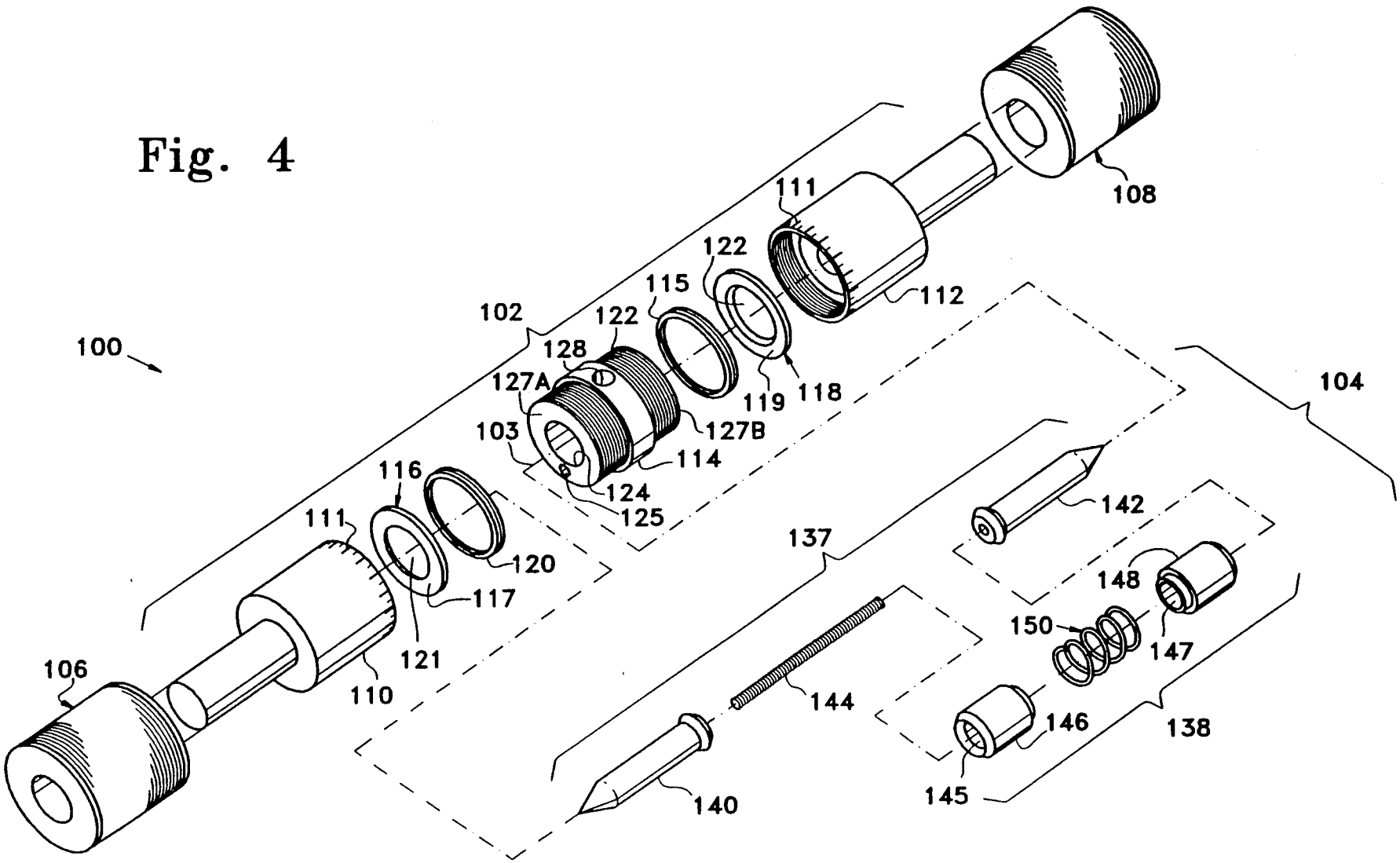
FIG. 4 shows an exploded perspective view of the preferred embodiment of the present invention.
Figure 6:
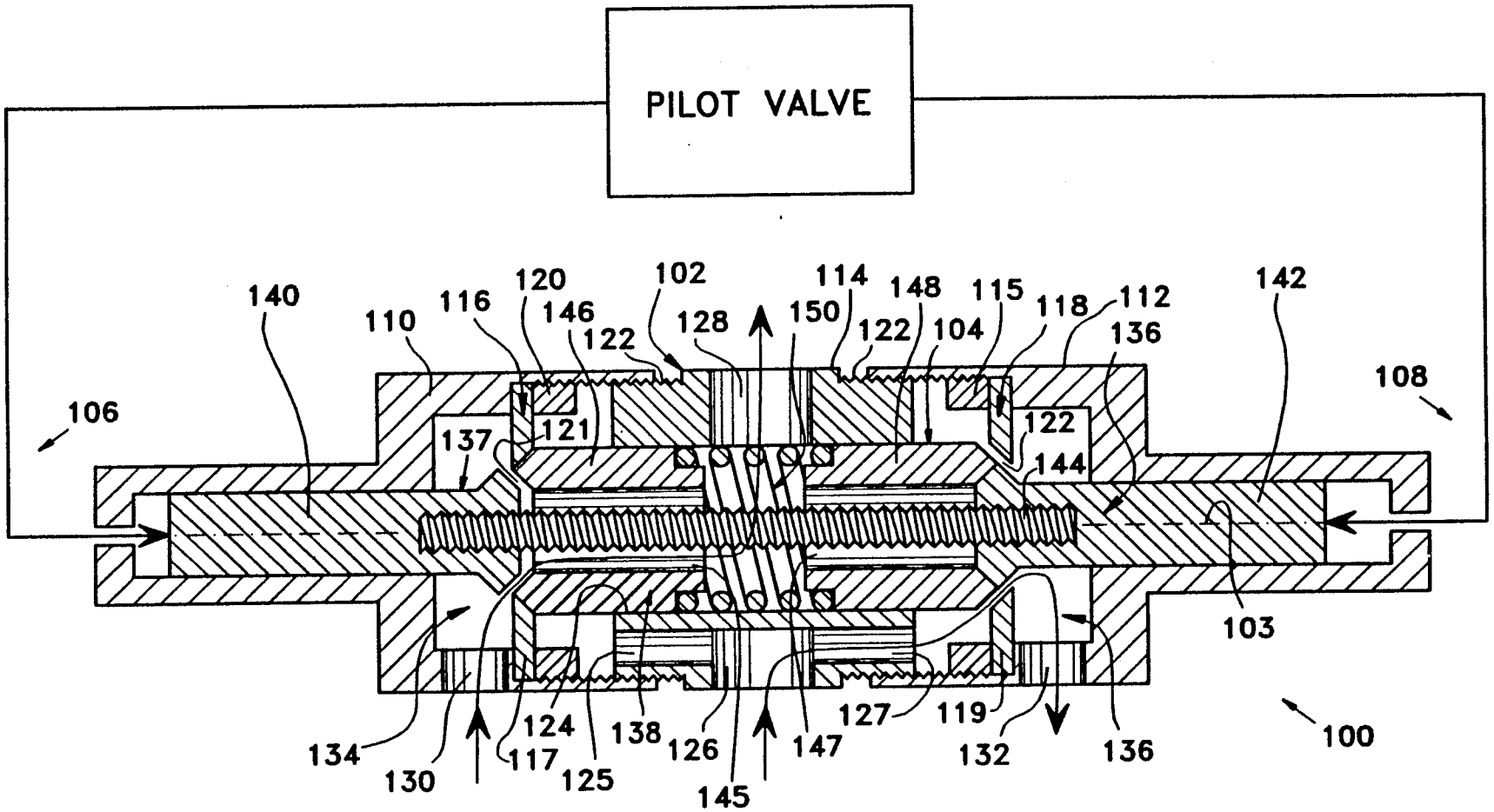
FIG. 6 shows, somewhat in schematic format, a cross-sectional side view of the preferred embodiment of the present invention actuated by a pilot valve.

Reference is now made to FIGS. 3 and 4. The valve of the present invention is signified by reference numeral 100. FIG. 3 shows the cross-sectional side view of valve 100 and FIG. 4 illustrates valve 100 in a perspective view. Valve 100 generally comprises valve housing 102 and synchronized poppet means 104. Additionally, actuating means 106 and 108 can be attached onto the housing 102. In the preferred embodiment, actuating means 106 and 108 are electromagnets. Notice that actuating means can be devices other than electromagnets. For example, actuating means 106 and 108 can be mechanical arms tied to a pilot stage of another fluid valve. Such an arrangement is exemplified by the illustration shown in FIG. 6.

For the ease of manufacturing and servicing, valve housing 102 is built with separate parts assembled together. In the preferred embodiment as shown in FIG. 3 and FIG. 4, components of housing 102 are generally cylindrical in shape and share a common axis 103. Housing 102 comprises first shell 110, second shell 112, and main shell 114. First orifice 116 is placed inside first shell 110 and locked into place by first lock ring 120. Similarly, orifice 118 is also securely mounted inside second shell 112 by second lock ring 115. Orifices 116 and 118 also comprises flange portions 117 and 119 and aperture portions 121 and 122 respectively. First shell 110 and second shell 112 are fixedly screwed onto main shell 114 Via screw threads 122. Notice that bore 124 is defined within main shell 114. In the preferred embodiment, bore 124 is shaped cylindrically and is co-axial with housing 102 on common axis 103. Moreover, inlet port 126 and outlet port 128 are formed in main shell 114. Inlet port 126 is formed through bore 124 and is capable of fluid communication with bore 124. In addition, first conduit 125 and second conduit 127 are also formed through inlet port 126 and both conduits 125 and 127 are capable of fluid communication with inlet port 126 as is clearly shown in FIG. 3. First shell 110 and orifice 116 defines first passageway 134. First passageway 134 also comprises first control port 130 which is formed through first shell 110 and is capable of fluid communication with first passageway 134. In a similar manner, second passageway 136 is defined within orifice 118 and second shell 102 and having second control port 132 formed through second shell 112 and is capable of fluid communication with second passageway 136. First and second passageways 134 and 136 are located at the extended ends of bore 124 and are generally coaxial with common axis 103.

Synchronized poppet means 104 comprises a rigid portion 137 and a resilient portion 138. Rigid portion 137 is built with first external member 140 adjustably attached to second external member 142 via screw shaft 144. Resilient portion 138 is slidably mounted within rigid portion 137 Resilient portion 138 comprises first internal member 146 urged against second internal member 148 via bias means 150. In the preferred embodiment, bias means 150 is a coil spring. There are fluid tunnels 145 and 147 axially formed through first and second internal members 146 and 148 respectively. Fluid tunnels 145 and 147 also allow screw shaft 136 to pass through when resilient portion 138 reciprocates within rigid portion 137. The entire poppet means 104 is slidably mounted within valve housing 102 and synchronized poppet means is capable of reciprocal movement within valve housing 102.

The assembly of valve 100 is simple and straight-forward. To begin with, for example, screw shaft 144 is first screwed into first external member 140. First internal member 146, bias means 150, and second internal member 148 are slid into screw shaft 144 in that order. Second external member 142 is then screwed in and the assembly of synchronized poppet means 104 is complete.

The assembly of valve housing 102 can start with first shell 110. Orifice 116 is then mounted into first shell 110 by tightening first lock ring 120 into first shell 110 through screw threads. Similarly, second orifice 118 can be mounted onto second shell 112 in the same manner.

The assembled poppet means 104 is then inserted into bore 124 of main shell 122. The protruding ends of synchronized poppet means 104 out of main shell 122 are then covered by screwing the assembled first and second shells 110 and 112 onto main shell 122. It should be noted that both first and second shells 110 and 112 are adjustably mounted to proximal end 127A and distal end 127B of main shell 114 respectively through screw threads 122. First and second shell 110 and 112 further perform the duty of restricting the span range of reciprocal movement of first and second external members 140 and 142 respectively within valve housing 102 Reference is now made to FIG. 3. FIG. 3 shows valve 100 at its fluid traverse position. Physical proximity of second internal member 148 and second external member 142 to orifice 118 during fluid traverse position determines the fluid flow rate from inlet port 126 to second passageway 136. Linear advancement of second shell 112 towards main shell 114 by turning second shell 112 through screw thread 122 further narrows the fluid passage in aperture portion 122 of orifice 118. Consequently, the rate of fluid flow from inlet port 126 to second passageway 136 is further curtailed. The amount of linear movement of second shell 112 with respect to main shell 114 can be directly read from vernier scale (FIG. 4) marked radially on the exterior rim portion of second shell 112. Similarly, due to the symmetry of the design, the rate of fluid flow can also be regulated by manipulating first shell 110 in a similar fashion. Notice that a single adjustment of either first shell 110 or second shell 112 with respect to main shell 114 is sufficient to regulate fluid flows evenly in both the fluid traverse position and the fluid reverse position. This feature enables valve 100 to be adjusted conveniently and externally, without any disassembling of the valve structure. Having this feature is especially beneficial in servicing of valve 100. For instance, due to prolong use, one of the internal member 146 or 148 is damaged and needs a replacement. A new replacement part can easily be substituted without difficulty. There is little need for internal adjustments or calibrations after replacement as commonly demanded by other types of valves mentioned previously.

Finally, actuating means such as electromagnets 106 and 108 are then snapped onto first and second shells 110 and 112 and valve 100 is ready for operation.

Figure 5A:
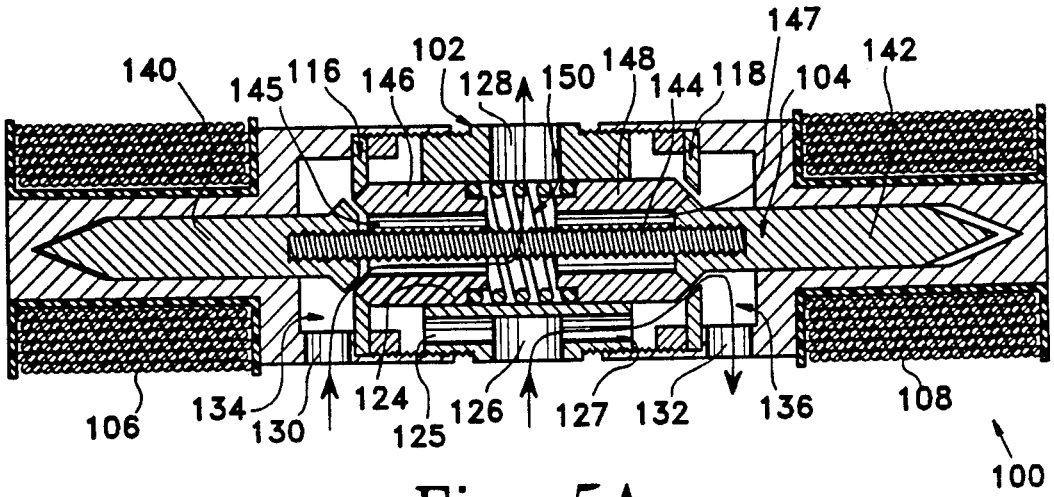
FIG. 5A shows a cross-sectional side view of the preferred embodiment of the present invention at its fluid traverse position.
Figure 5B:
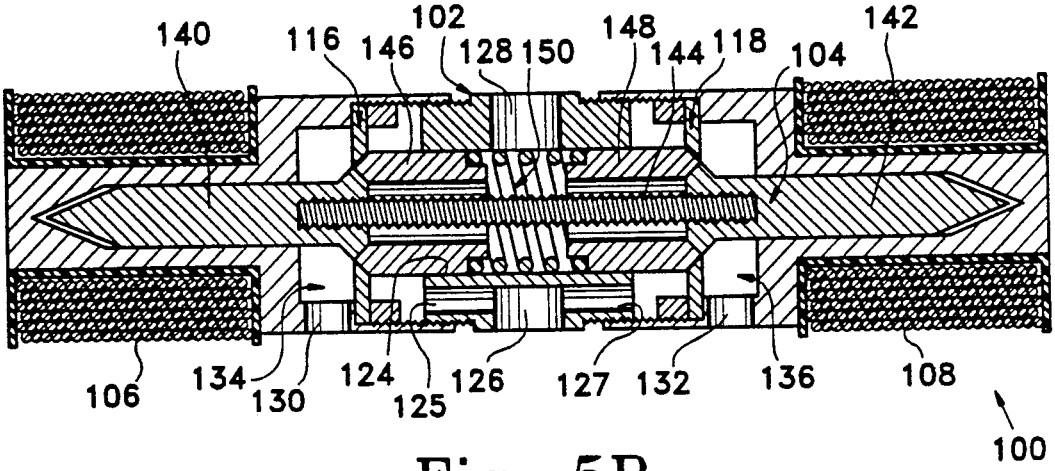
FIG. 5B shows a cross-sectional side view of the preferred embodiment of the present invention at its fluid closed position.

For the operation of the valve of the present invention, reference is now made to FIGS. 5A to 5B. FIG. 5A shows valve 100 at a fluid traverse position. Electromagnet 106 is activated and attracted first external member 140 towards the left in the drawing. Second external member 142 being adjustably fixed to first external member through screw shaft 144 is also pulled towards the left passing through second orifice 118 and directly pressing second internal member 148. Bias means 150 is being compressed and urges against first internal member 146 onto orifice 116. This action encloses bore 124 to second passageway 136 but opens inlet port 126 to second passageway 136 through conduit 127. At the same time, first external member 140 passes through orifice 116 and opens up another fluid communication path between bore 124 and first passageway 134. The fluid path is completed in the following manner. Fluid from inlet port 126 flows into second passageway 136 and out of second control port 132. Second control port 132 and control port 134 are in direct fluid communication with each other at a fluid path external to valve 100. The fluid path is normally located in the mechanical device being actuated. The communication linkage is not shown in the drawings. Fluid coming out of second control port 132 flows back into first control port 130 via external fluid communication linkage (not shown) and is directed into first passageway 134. Fluid from first passageway 134 exits out of outlet port 128 via fluid tunnel 145 and bore 124.

To reverse the direction of fluid flow, valve 100 first attains a fluid closed position. The fluid closed position is clearly shown in FIG. 5B. Unlike the prior art poppet valves, the fluid close position distinctively dictates the traffic flow of each of the fluid ports and passageways and eliminated the ambiguity of the undetermined fluid flow states. The implementation of the fluid closed position enables the reciprocal movement of poppet means 138 with more agility and demands less driving force. This prevents the electromagnet to be driven into deep saturation. In other words, reduced distance travelling into the electromagnetic hysteresis shortens the recovery time of the electromagnets and as a consequence, poppet means 104 can react responsively and be able to reciprocate at high frequency.

As shown in FIG. 5B, cut-off of electric current driving electromagnet 106 releases poppet means 104 to the right. This action relaxes the tension of bias means 150 allowing first and second internal members 146 and 148 to be urging against first and second orifices 116 and 118 respectively within bore 124. This action denies fluid access of bore 124 to both first and second passageways 134 and 136 and causes all fluid communications to be totally cut-off. The fluid closed position is clearly shown in FIG. 5B.

Figure 5C:
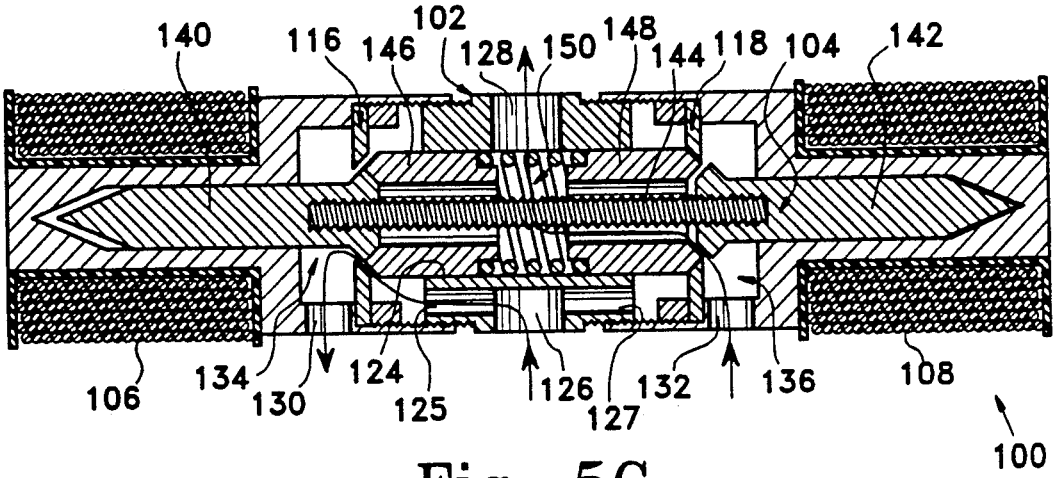
FIG. 5C shows a cross-sectional side view of the preferred embodiment of the present invention at its fluid reversed position.

FIG. 5C shows valve 100 to be at a fluid reverse position. In this position, electromagnet 108 is being activated by electric current and attracts second external member 142 to the right. Orifice 118 stops second internal member 148 from any further rightward movement. At the same time first internal member 140 passes through first orifice 116, urging first internal member 146 and compressing bias means 150. This action opens up bore 124 to second passageway 136. Fluid flows from inlet port 126 and out of first control port 130 via first conduit 125 and first passageway 134. Fluid coming out of first control port 130 passes through fluid linkage (not shown) in the mechanical device being actuated and back into second control port 132. Fluid flowing into control port 132 passes through second passageway 136, fluid tunnel 147, bore 124, and exits out of outlet port 128.

The opposite but simultaneous flow of fluid in an out of first control port 130 and second control port 132 are used to drive various mechanical devices.

Notice that synchronized poppet means 104 reciprocates within bore 125 synchronously, namely, the absolute completion of one fluid position before the start of another fluid position, with no overlaps of fluid positions in the time domain.

Moreover, in the preferred embodiment, electromagnets 206 and 108 are active separately during fluid traverse position and fluid reverse position respectively. It here will be noted that electromagnets can assume other modes of operations. For example, only one magnet is utilized during the entire three fluid positions. Another possibility is that both electromagnets are active during a single fluid position. For instance, during fluid traverse position, electromagnet 106 is active and performing the pulling function while electromagnet 108 is also active and performing the pushing function simultaneously.

With the unique poppet and seat arrangement in the valve of the present invention as was described above, notice that there is less stringent manufacturing tolerance requirements. In contrast with the aforementioned spool-type valves, the valve of the present invention can be built with inexpensive materials, especially materials that are moldable or less difficult to mill such as nylon, Teflon, aluminum or plastic. Manufacturing cost can be substantially reduced in comparison. The relative relaxed tolerance requirement and the availability of a wide variety of materials are especially beneficial for miniaturization in the production process.

Finally, other changes are possible with the scope of this invention. For example, the fluid positions described above can be semantically exchanged, that is the fluid traverse position can be called fluid reverse position and vice verse.

It is also clear that valve housing can be a unitary housing resulting from a one-step molding or milling process.

It is also obvious that actuating means can be other actuating devices besides electromagnets.

It is also apparent that the valve can be built as a disposable unit with housing fully sealed and no internal components of the valve is intended to be replaceable.

While the present invention refers to the preferred embodiment thereof, it will be understood by those skilled in the art that these and other changes in form and detail may be made therein without departing from the scope and spirit of the present invention.

I claim:

1. A fluid valve comprising:

a valve housing having a bore, said bore having a first passageway and a second passageway generally extending adjacent the ends of said bore, said housing further comprises an inlet port and an outlet port generally radially formed through said valve housing; and sychronized poppet means having a resilient portion and a rigid portion, said rigid portion comprises a first external member and a second external member with said first external member adjustably fixedly attached to said second external member, said resilient portion comprises a first internal member and a second internal member, with said internal members having fluid tunnels therethrough, said resilient portion being slidably mounted within said rigid portion with said first internal member resiliently biasing said second internal member;

said synchronized poppet means being reciprocally mounted within said bore and in between said passageways and being adapted for enclosing said bore to at least one of said passageways, and being adapted for enclosing said bore to all of said passageways, such that when said second external member and said second internal member enclose said bore to said second passageway allowing fluid communication between said bore to said first passageway through the fluid tunnel of said first internal member and allowing fluid communication between said inlet port to said second passageway enables said valve to be at fluid traverse position, and such that when said external and internal members enclose said bore to all of said passageways and cut off all fluid communications between said bore to all of said passageways enables said valve to be at a fluid closed position, and such that when said first external member and said first internal member enclose said bore to said first passageway allowing fluid communication between said bore to said second passageway through the fluid tunnel of said second internal member and allowing fluid communication between said inlet port to said first passageway enables said valve to be at a fluid reverse position.

2. The fluid valve as set forth in claim 1 wherein said bore further comprises a first orifice mounted substantially adjacent said first internal member and said first external member and a second orifice mounted substantially adjacent said second internal member and said second external member, each of said orifices having a flange portion and an aperture portion, said flange portions define a volume of space within said bore restricting the reciprocal movement of said resilient member within said volume of space, said rigid portion being capable of passing through said aperture portions during the reciprocal movement of said poppet means.

3. The fluid valve as set forth in claim 1 wherein said valve housing further comprises:

a main shell having a proximal end and a distal end;

a first shell and a second shell adjustably mounted to the proximal end and the distal end respectively of said main shell and adjustably restricting the reciprocal movement of said resilient portion within said valve housing.

4. The fluid valve as set forth in claim 1 further comprises actuating means for reciprocating said synchronized poppet means.

5. The fluid valve as set forth in claim 4 wherein said actuating means reciprocates said synchronized poppet means proportionally.

6. The fluid valve as set forth in claim 4 wherein said actuating means is an electromagnet.

7. The fluid valve as set forth in claim 4 wherein said actuating means is a pilot valve.

8. A fluid valve comprising:

a valve housing having a bore, said bore having a first passageway and a second passageway generally extending adjacent the ends of said bore, said housing further comprises an inlet port and an outlet port generally radially formed through said valve housing;

sychronized poppet means having a resilient portion and a rigid portion, said rigid portion comprises a first external member and a second external member with said first external member adjustably fixedly attached to said second external member, said resilient portion comprises a first internal member and a second internal member, with said internal members having fluid tunnels therethrough, said resilient portion being slidably mounted within said rigid portion with said first internal member resiliently biasing said second internal member; and a first orifice mounted substantially in between said bore and said first passageway and a second orifice mounted substantially in between said bore and said second passageway, each of said orifices having a flange portion and an aperture portion, said flange portions define a volume of space within said bore;

said synchronized poppet means being reciprocally mounted within said bore and in between said passageways, with said resilient portion being restricted in reciprocal movement within said volume of space and with said rigid portion capable of passing through said aperture portions, said synchronized poppet means being adapted for enclosing said bore to at least one of said passageways, and being adapted for enclosing said bore to all of said passageways, such that when said second external member and said second internal member enclose said bore to said second passageway allowing fluid communication between said bore to said first passageway through the fluid tunnel of said first internal member and allowing fluid communication between said inlet port to said second passageway enables said valve to be at fluid traverse position, and such that when said external and internal members enclose said bore to all of said passageways and cut off all fluid communications between said bore to all of said passageways enables said valve to be at a fluid closed position, and such that when said first external member and said first internal member enclose said bore to said first passageway allowing fluid communication between said bore to said second passageway through the fluid tunnel of said second internal member and allowing fluid communication between said inlet port to said first passageway enables said valve to be at a fluid reverse position.

9. The fluid valve as set forth in claim 8 wherein said valve housing further comprises:

a main shell having a proximal end and a distal end;

a first shell and a second shell adjustably mounted to the proximal end and the distal end respectively of said main shell and adjustably restricting the reciprocal movement of said resilient portion within said valve housing.

10. The fluid valve as set forth in claim 8 further comprises actuating means for reciprocating said synchronized poppet means.

11. The fluid valve as set forth in claim 10 wherein said actuating means reciprocates said synchronized poppet means proportionally.

12. The fluid valve as set forth in claim 10 wherein said actuating means is an electromagnet.

13. The fluid valve as set forth in claim 10 wherein said actuating means is a pilot valve.

* * * * *